US006123824A

United States Patent [19]

Sano et al.

[11] Patent Number: 6,123,824

[45] Date of Patent: Sep. 26, 2000

[54] PROCESS FOR PRODUCING PHOTO-ELECTRICITY GENERATING DEVICE

[75] Inventors: Masafumi Sano, Kyoto-fu; Toshimitsu Kariya, Nara, both of Japan

[73] Assignee: Canon Kabushiki Kaisha, Tokyo, Japan

[21] Appl. No.: 08/990,566

[22] Filed: Dec. 15, 1997

[30] Foreign Application Priority Data

Dec. 13, 1996 [JP] Japan ..... 8-333641

[51] Int. Cl.[7] ..... C25D 5/02

[52] U.S. Cl. ..... 205/124; 205/333

[58] Field of Search ..... 205/155, 124, 205/316, 333; 204/192.15, 192.26, 192.25

[56] References Cited

U.S. PATENT DOCUMENTS 5,804,466 9/1998 Arao et al. ..... 438/95

FOREIGN PATENT DOCUMENTS 8-217443 8/1996 Japan .

OTHER PUBLICATIONS

H. Sannomiya, "a–SiC/a–Si/a–SiGe Multi–Bandgap Stacked Solar Cells With Bandgap Profiling", Tech. Dig. Intl. PVSEC–5, Kyoto, Japan, 1990 No month available.

Y. Inoue, "Optical Confinement Effect in a–SiGe Solar Cells on Stainless Steel Substrates", preprint 29p–MF–2 for the 51st Acad. Lect. of the Japan Soc. of App. Phys., Autumn 1990 No month available.

M. Izaki, "Electrolyte Optimization for Cathodic Growth of Zinc Oxide Films", J. Electrochem. Society., vol. 143, No. 3, Mar. 1996.

*Primary Examiner*—Kathryn Gorgos
*Assistant Examiner*—Erica Smith-Hicks
*Attorney, Agent, or Firm*—Fitzpatrick, Cella, Harper & Scinto

[57] ABSTRACT

A photo-electricity generating device is produced through the steps of: immersing an electrode and an electroconductive substrate in an aqueous solution comprising nitrate ions and zinc ions, supplying a current passing through a gap between the electrode and the electroconductive substrate to form a first zinc oxide layer on the electroconductive substrate, etching the first zinc oxide layer, and forming a semiconductor layer on the zinc oxide layer. The zinc oxide layer may preferably be formed in two zinc oxide layers under different electrudeposition conditions. In this case, the etching step may preferably be performed between steps for forming these zinc oxide layers. The zinc oxide layer is provided with an unevenness at its surface suitable for constituting a light-confining layer of a resultant photo-electricity generating device.

49 Claims, 8 Drawing Sheets

PROCESS FOR PRODUCING PHOTO-ELECTRICITY GENERATING DEVICE

FIELD OF THE INVENTION AND RELATED ART

The present invention relates to a process for producing an photo-electricity generating device including an zinc oxide layer formed through electrodeposition (electrolytic deposition).

In a process for producing an electro-electricity generating device, there has been known that a reflection layer of, e.g., metal is formed on the back side of an semiconductor layer in order to improve a light-collection efficiency of the photo-electricity generating device on a long wavelength. Further, there has also been known that a transparent electroconductive layer having an unevenness is formed between the reflection layer and the semiconductor layer to obtain a light-confining (optical confinement) effect that an optical distance (optical path) of reflected light is elongated or lengthened to obtain an effect of suppressing an excessive current flowing at the time of an occurrence of a shunt passing. As the transparent elebtroconductive layer, there has been widely used an zinc oxide (ZnO) film formed by sputtering. Zinc oxide is different from tin oxide and indium oxide in that it is not reduced when exposed to plasma containing hydrogen, so that a semiconductor layer is suitably formed on the zinc oxide film by a chemical vapor deposition (CVD) process.

More specifically, by the use of the reflection layer and the zinc oxide layer in combination, an increase in short circuit current based on the light-confining effect has been achieved as described in, e.g., "Optical confinement Effect in a-SiGe solar cells on Stainless Steel Substrates", Preprint (29p-MF-2) for the 51-th Academic Lecture of The Japan Society of Applied Physics, p747, Autumn, 1990 or "a-SiC/a-Si/a-SiGe Miti-Bandgap Stacked Solar Cells with Bandgap Profiling" Sannorniya et al., Technical Digest of the International PVSEC-5, Kyoto, Japan, p381, 1990.

Further, there have been reported that the zinc oxide film is formed by electrolysis in an aqueous solution containing zinc ions ($Zn^{2+}$) and nitrate ions ($NO_3^-$) as in "Electrolyte Optimization for Cathodic Growth of Zinc Oxide Films", M. IZAKI and T. Omi, J. Electrochem. Soc., Vol. 143, March 1996, L53 or Japanese Laid-Open Patent Application (JP-A) 8-217443.

However, the former zinc oxide layer having the light-confining effect as described above is generally formed by a vacuum production process, such as vacuum deposition by using resistance heating or electron beam, sputtering, ion plating or chemical vapor deposition (CVD), thus being accompanied with problems, such as an expensive preparation cost of a target material, the necessity of using a vacuum process, an expensive vacuum apparatus, and a low utilization efficiency of the materials used. As a result, a photo-electricity generating device (e.g., solar cell) produced by the vacuum process becomes very expensive, thus constituting a barrier to industrial applications thereof.

The latter zinc oxide layer can be formed inexpensively by the electrolysis in the aqueous solution containing zinc ion and nitrate ion but is accompanied with the following problems (1)–(4).

(1) Particularly, in the case where a current density or a solution concentration is increased, an anomalous growth of a deposited (precipitated) crystal in the form of a needle, sphere or branch (dendritic growth) with a particle size above a micron order is liable to occur in the deposit.

Accordingly, if the resultant zinc oxide film having such an anomalous growth portion is used as a part of the photo-electricity generating device, the anomalous growth portion is liable to induce a shunt passing phenomenon in the photo-electricity generating device.

(2) The size of zinc oxide particles (crystal) is liable to fluctuate, thus leading to a uniformity in the resultant zinc oxide film of a large area.

(3) When the zinc oxide film is applied to a photo-electricity generating device, adhesive properties between the zinc oxide film and an underlying layer (electroconductive substrate) and/or between the zinc oxide film and an overlying layer (semiconductor layer) become insufficient.

(4) The resultant zinc oxide film has a smooth (flat) surface, thus failing to provide a surface in an appropriate uneven shape providing the light-confining effect.

SUMMARY OF THE INVENTION

In view of the above problems, an object of the present invention is to provide a process for producing a photo-electricity generating device including a zinc oxide layer suitable for application to a light-confining layer of a photo-electricity generating device.

According to the present invention, there is provided a process for producing a photo-electricity generating device, comprising the steps of:

immersing an electrode and an electroconductive substrate in a first aqueous solution comprising nitrate ions and zinc ions, supplying a current passing through a gap between the electrode and the electroconductive substrate to form a first zinc oxide layer on the electroconductive substrate, etching the first zinc oxide layer, and forming a semiconductor layer on the first zinc oxide layer.

In the above process of the present invention, a step of forming a second zinc oxide layer similar to that for the first zinc oxide layer may be performed between the etching step and the first zinc oxide-layer-forming step.

In the present invention, the aqueous solution may preferably comprise a carbohydrate in order to suppress anomalous growth of zinc oxide crystal particles, thus decreasing a leakage current to improve a photoelectric conversion efficiency and a production yield.

On the electroconductive substrate described above, a metal layer of a metal having a high reflectance may preferably be formed to enhance a reflectance as a support for the photo-electricity generating device, thus providing the device with a high photoelectric conversion efficiency.

Examples of a material for the metal layer may include Au, Ag, Cu, CuMg (Cu—Mg alloy) and Al. Al is inexpensive and thus suitable for the metal layer material but is dissolved in an aqueous solution comprising nitrate ions and zinc ions, so that it is difficult to effect electrodeposition of the zinc oxide layer on the Al layer. In this instance, however, it is possible to form on the Al layer an intermediate layer which is transparent and electroconductive and is not dissolved in the aqueous solution.

As an etchant used in the etching step, acetic acid or its aqueous solution may preferably be used.

The zinc oxide layer may preferably be formed in a laminate structure comprising a lower layer having a smooth surface consisting of minute crystal particles and excellent in adhesive properties with the electroconductive substrate and a upper layer having an appropriate uneven surface consisting of larger crystal particles and having a large light-confining (optical confinement) effect. As a result, the zinc oxide layer of the laminate type can compatibly attain good adhesive properties and an effective optical confinement. These layers (lower layer and upper layer) may be formed under different electrodeposition conditions, such as different solution temperatures, different current densities and different solute concentrations.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
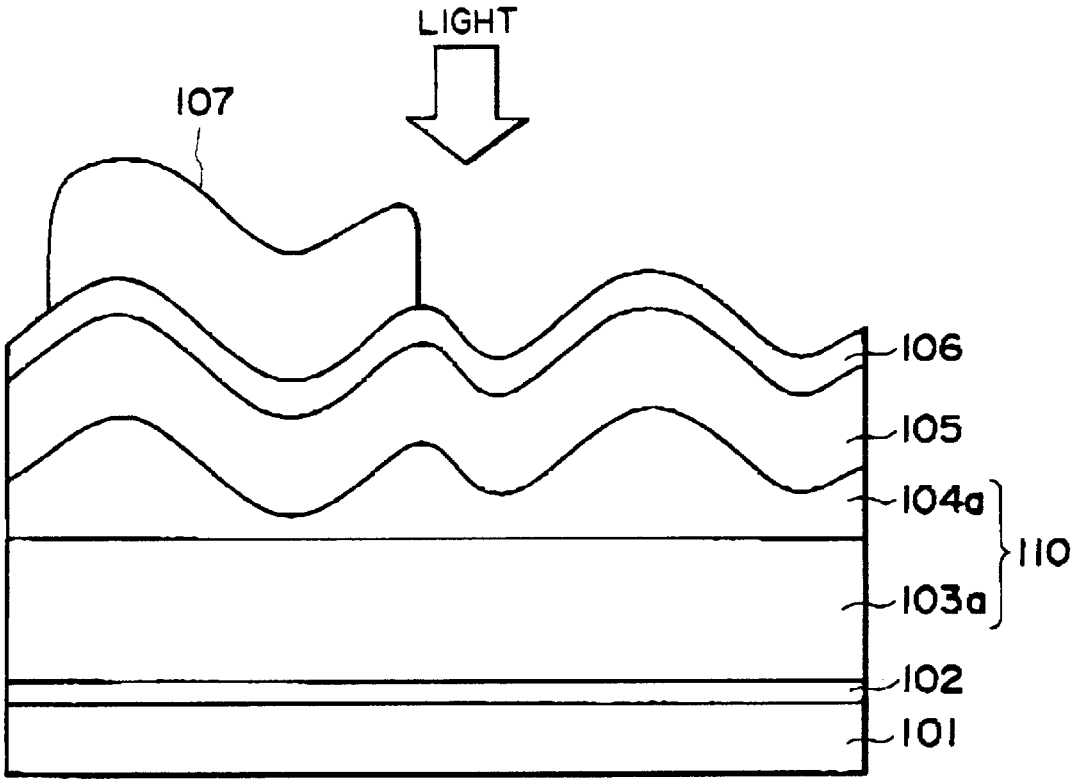
FIGS. 1A and 1B are respectively a schematic sectional view showing an embodiment of a photo-electricity generating device produced through the process according to the present invention.
Figure 1B:
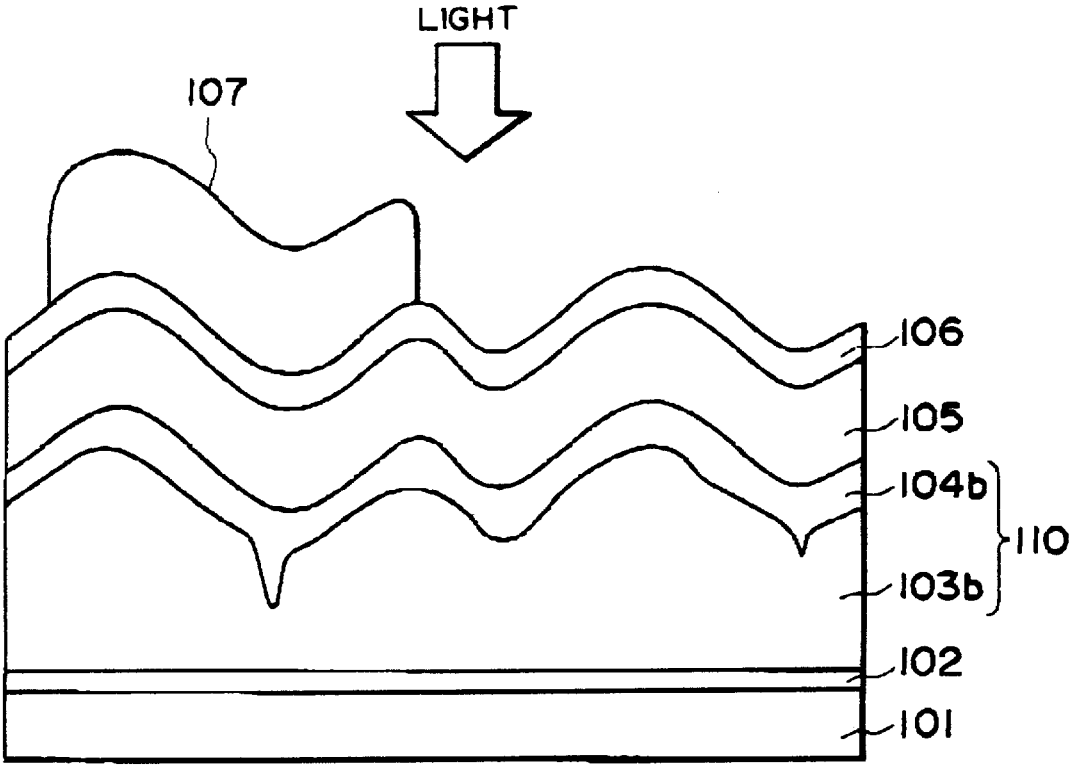

According to the process according to the present invention, a photo-electricity generating device having a sectional structure as shown in FIG. 1A or 1B is produced.

Referring to FIGS. 1A and 1B, the photo-electricity generating device principally include an electroconductive substrate 101, a backside reflection layer 102 disposed on the electroconductive substrate 101, a zinc oxide 110 layer disposed on the backside reflection layer 102 and consisting of two layers (103*a* and 104*a*, or 103*b* and 104*b*), a semiconductor layer 105 disposed on the zinc oxide layer 110, an upper transparent electrode 106 disposed on the semiconductor layer 105, and a collector (grid) electrode 107 disposed on the transparent electrode 106.

The backside reflection layer may principally comprise Au, Ag, Cu, Cu—Mg alloy or Al, and may be coated with an intermediate layer (not shown).

<Zinc Oxide Layer>

Referring to FIG. 1A, the zinc oxide layer 110 comprises a lower layer 103*a* and an upper layer 104*a* disposed thereon. The surface of the upper layer 104*a* is etched to have an appropriate unevenness.

The upper layer 104*a* may preferably be formed at a temperature (aqueous solution temperature) of at least 80° C. The upper layer 104*a* may preferably be formed at a current density which is smaller than that for the lower layer 103*a*. Further, the upper layer 104*a* may desirably be formed at concentration of nitrate ions and zinc ions which are lower than those for the lower layer 103*a*, respectively.

Referring to FIG. 1B, the zinc oxide layer 110 comprises a first zinc oxide layer 103*b* and a second zinc oxide layer 104*b* disposed thereon.

The first zinc oxide layer 103*b* is provided with an appropriate surface unevenness by etching, and the second zinc oxide layer 104*b* is formed after the etching step.

The first zinc oxide layer 103*b* may have an upper layer and a lower layer similarly as in the zinc oxide layer 110 shown in FIG. 1A.

Figure 2A:
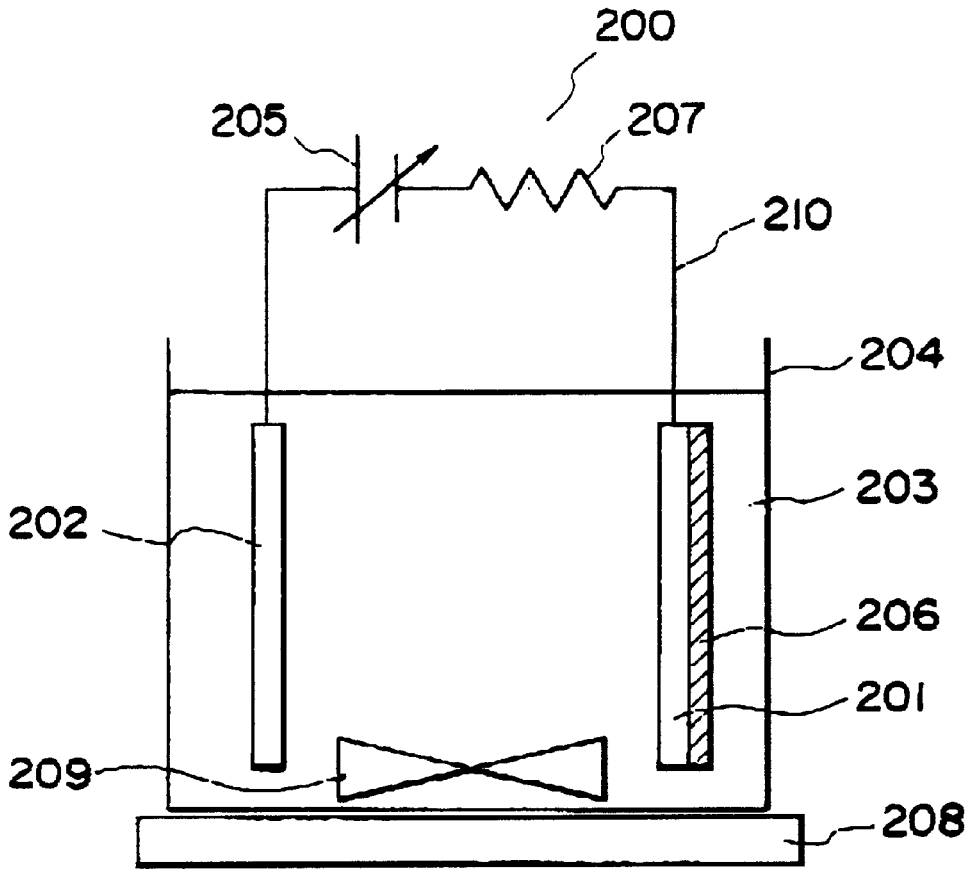
FIG. 2A is a schematic sectional view showing an apparatus for forming a zinc oxide layer used in the present invention.

In the process according to the present invention, a step of forming the zinc oxide layer (110, 103*a*, 104*a*, 103*b* and 104*b* shown in FIGS. 1A and 1B) will be described with reference to FIG. 2A showing a zinc oxide layer-forming apparatus 200.

Referring to FIG. 2A, the apparatus 200 includes an electroconductive substrate 201 (as a cathode), a counter electrode (as an anode) 202, an electrolytic solution (aqueous solution) 203, an electrolytic tank 204, a power supply 205, an insulating tape (sheet) 206, a load resistance 207, a heater 208 and a magnetic stirrer 209.

First, a zinc nitrate aqueous solution 203 having a prescribed concentration is prepared in the electrolytic tank 204 and sufficiently stirred by the magnetic stirrer 209 under heating with the heater 208 to heat the solution 203 up to a prescribed temperature. The counter electrode 202 and the electroconductive substrate 201 to which the insulating tape 206 is applied are electrically connected with each other via the power supply 205 and the load resistance 207, thus forming a circuit via the solution 203. A prescribed voltage is applied to the circuit at a constant-current mode, whereby a transparent zinc oxide film (layer) is formed (deposited) on the surface of the electroconductive substrate 201 (exactly, on the surface of the backside reflection layer) on the cathode side.

When the zinc oxide layer is formed in a prescribed thickness, the voltage application is interrupted or terminated. Immediately thereafter, the electroconductive substrate having thereon the zinc oxide layer having the prescribed thickness is taken out from the aqueous solution 203 and is sufficiently washed with pure water.

In the case where nitrate ion and zinc ion are supplied from zinc nitrate aqueous solution as the electrolytic solution 203, the zinc nitrate aqueous solution may preferably have a zinc nitrate (solution) concentration or content of 0.05–1.0 mol/l. The solution 203 may preferably be heated to keep at least 50° C. Further, a current density at the surface of the electroconductive substrate 201 may preferably be set to 0.1–100 mA/cm$^2$.

These electrodeposition conditions may appropriately changed depending on, e.g., the kind of the backside reflection layer formed on the electroconductive substrate, a sectional shape of the electroconductive substrate (or backside reflection layer) and a crystalline state. Generally, a larger zinc nitrate concentration provides a larger crystalline size (particle size) of the zinc oxide layer, thus being liable to provide a surface unevenness. Further, a lower solution temperature is liable to lead to a larger zinc oxide crystalline size. As the current density becomes large, a degree of the surface unevenness tends to decrease but the film-forming rate is increased.

Figure 2B:
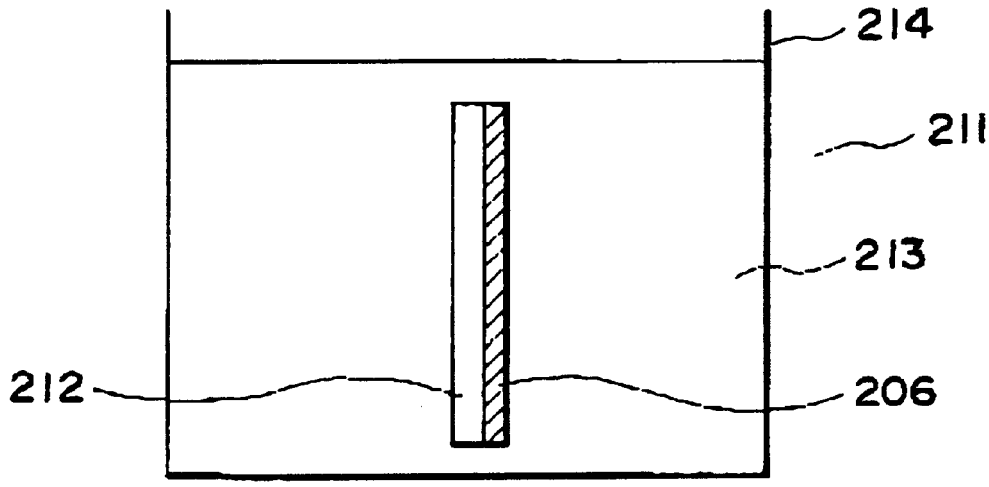
FIG. 2B is a schematic sectional view showing an etching apparatus of a zinc oxide layer used in the present invention.

FIG. 2B shows a schematic sectional view showing an embodiment of an apparatus 211 for etching the surface of the zinc oxide layer. The zinc oxide is amphoteric oxide, thus being soluble in acid and alkali.

As shown in FIG. 2E, an aqueous solution 213 (etchant) comprising an acid solution such as acetic acid, or an alkaline solution, such as ammonia water, is placed in an etching tank (bath) 214. An electroconductive substrate 212 coated with the zinc oxide layer on one side thereof and to which the insulating tape 6 is applied on the other side thereof is immersed in the aqueous solution 213.

As the aqueous solution 213 for etching (etching treatment), in addition to weak acid (acetic acid) and weak alkali (ammonia water), aqueous solutions of strong acid (e.g., nitric acid) and strong alkali (e.g., potassium hydroxide) each sufficiently diluted with water may be used.

In the process of the present invention, the aqueous solution 213 may preferably assume a pH (hydrogen ion exponent) value of 2–5 for the acid aqueous solution and a pH value of 9–12 for the alkaline aqueous solution.

In a specific example, the etching treatment may preferably be performed by using an appropriate acetic acid aqueous solution in a concentration (e.g., 0.01 mol/l) under conditions including a solution temperature (generally from room temperature to ca. 50 ° C., e.g., 25° C.) and an etching time (generally 5–30 sec., e.g., 10 sec.).

When the aqueous solution 213 (etchant) used contains a large amount of sulfate ions, sulfide ions or hydroxide ions; zinc sulfate, zinc sulfade or zinc hydroxide is correspondingly precipitated within the zinc oxide layer to lower a production yield in some cases. For this reason, in the present invention, the etchant (etching aqueous solution) 213 may preferably comprise acetic acid or an acetic acid aqueous solution, thus facilitating the formation of an uneven surface (of the zinc oxide layer) suitable for improving an optical confinement effect for a resultant photoelectricity generating device. The use of acetic acid (or its aqueous solution) allows an etching apparatus not including a particular acid resistant means.

Figure 3A:
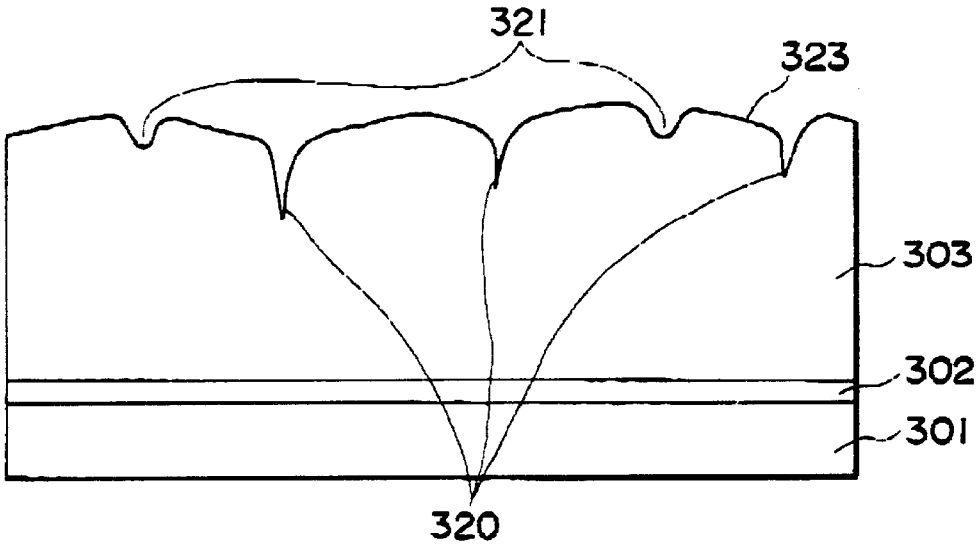
FIGS. 3A–3C are respectively a schematic sectional view for illustrating a sectional shape of a zinc oxide layer used in the present invention.

FIG. 3A shows an example of a sectional shape of a zinc oxide layer 303 formed on a backside reflection layer 302 covering an electroconductive substrate 301 when the above-mentioned etching treatment is not performed.

At a surface portion 323 of the zinc oxide layer 303, many (minute) depressions comprising sharp pits or depressions (or acute-angled depressions) 320 which is relatively deep and steep and moderate depressions 321 which relatively shallow and gentle. The sharp pits 320 are not desirable since they are liable to cause a short circuit of the photoelectricity generating device.

Figure 3B:
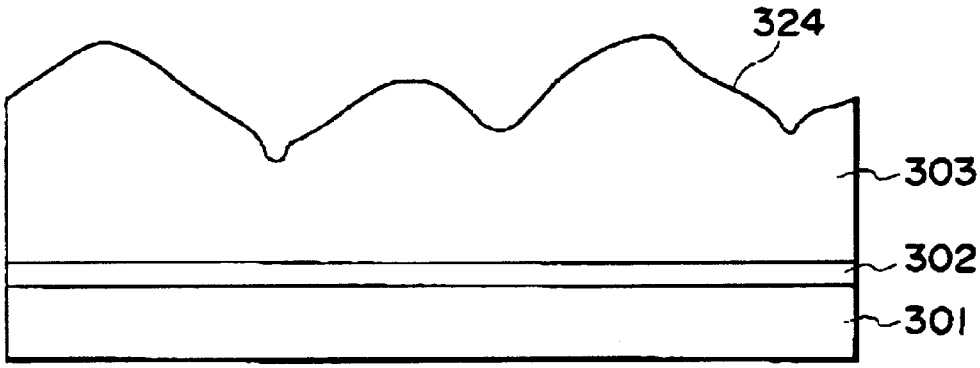

In the present invention such undesirable sharp pits 320 are aggressively utilized to provide a desirable sectional shape of the zinc oxide layer surface suitable for a light-confining layer. More specifically, when the zinc oxide layer 303 having the above-described sharp pits 320 as shown in FIG. 3A is subjected to the etching treatment described above, surrounding portions of the sharp pits (acute-angled depressions) 320 are eroded to provide moderate depressions and projections having a desirable (uneven) sectional shape (gentle wavy shape) to a surface portion 324 of a zinc oxide layer 303 as shown in FIG. 3B. The resultant uneven surface is provided with remarkably less acute-angled depressions or substantially free from acute-angled depressions.

The pits 320 before the etching treatment may preferably have an average diameter (or long-axis diameter) of 0.05–0.3 $\mu$m at an entrance portion thereof and a density of 100–1000 pits/100 $\mu m^2$.

The acute-angled depressions (sharp pits) (e.g., 320 shown in FIG. 3A) have a relatively large slope angle (formed between a slope (side wall) of the depression and a horizontal line parallel to the electroconductive substrate surface) of preferably at least 70 degrees.

Before the etching treatment, the zinc oxide layer 303 has a surface shape having such acute-angled depressions providing the relatively large slope angle (e.g., at least 70 degrees). After the etching treatment, the zinc oxide layer 303 has an uneven (gentle wavy-shaped) surface having no depression or sharp pits (not shown) or a substantially no (or remarkable less) depressions or sharp pits providing the relatively large slope angle as shown in FIG. 3B. Specifically, as shown in FIG. 3B, the resultant depressions on the surface of the zinc oxide layer 303 includes a minor sharp pit portion (e.g., having a slope angle of at least 70 degrees) at the bottom of the depression(s). In the present invention, however, such a sharp pit portion occupies at most 1/10 of the entire slope region of the associated depression, thus not adversely affecting the resultant photoelectric properties of the photo-electricity generating device in most cases.

The zinc oxide layer 303 may generally have a surface unevenness (Ra) of 50–300 Å (e.g., 200 Å) before the etching treatment and an Ra of at least 600 Å (e.g., 1000 Å) after the etching treatment, each measured by using an atomic force microscope ("Q-scope", mfd. by Quesant Co.) provided with a needle probe for scanning the zinc oxide layer surface in a length of 1500 $\mu$m (5 $\mu$m×300) while retaining a repulsion force between the probe and the zinc oxide layer at a certain level.

Figure 3C:
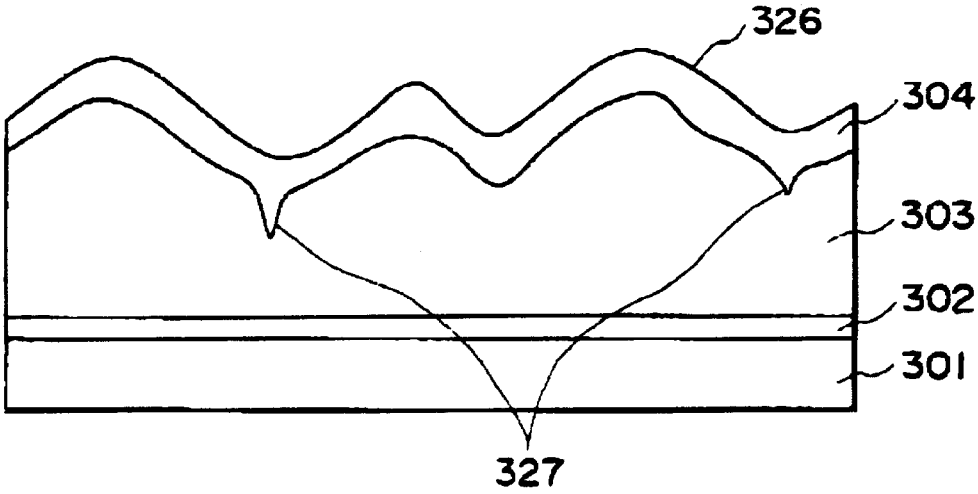

Even after the etching treatment, relatively sharp pits 327 as shown in FIG. 3C still remain at the surface of a (first) zinc oxide layer 303 in some cases. In this case, a second zinc oxide layer 304 may be formed on the first zinc oxide layer 303 by the above-described electrodeposition so as to fill or plug the sharp pits 327, thus providing a gentle wavy shape to a surface portion 326 of the second zinc oxide layer 304 similarly as in the zinc oxide layer 303 shown in FIG. 3B. It is possible to form the second zinc oxide layer 304 so as to effectively fill the sharp pits 327 by increasing an current density for the electrodeposition process so that the current density is larger than that for the first zinc oxide layer 303. This is because the larger current density allows a uniform deposition of zinc oxide crystal particles.

The second zinc oxide layer 304 may be formed by a conventional sputtering process.

In a specific embodiment, the gentle wavy shape at the surface of the zinc oxide layer 304 (e.g., as shown in FIG. 3B) may preferably be provided by forming an upper zinc oxide layer at ca. 85° C. (as the electrolytic solution temperature) on a lower zinc oxide layer formed at ca. 65° C. Alternatively, it is possible to provide such a gentle wavy shape by forming the upper zinc oxide layer on the lower zinc oxide layer so that a current density and/or a zinc nitrate concentration for forming the upper zinc oxide layer is decreased compared with those for the lower zinc oxide layer.

When the zinc oxide layer is formed though the electrodeposition process at a relatively low temperature (as the solution temperature) of at most 70° C., the resultant zinc oxide layer is in a dense state, thus merely allowing a uniform etching action not to largely change or modify the surface shape (comprising the sharp and moderate pits). On the other hand, when the zinc oxide layer is formed at a relatively high temperature of at least 85° C., the resultant zinc oxide layer is in a relatively sparse state where crystal growth occurs in a direction perpendicular to the surface of the backside reflection layer (and the electroconductive substrate), thus being liable to cause an ununiform etching action to be presumably considered to provide the surface shape (gentle wavy shape) as shown in FIG. 3B.

Further when the lower layer (lower zinc oxide layer) is formed at a higher current density to provide a substantially flat or smooth deposition surface, thus causing crystal growth in a direction parallel to the backside reflection layer surface to provide relatively less pits which are deep and large. On the lower layer, the upper layer is formed at a lower current density and a lower solute concentration, whereby crystal growth in the perpendicular direction to the backside reflection layer surface occurs, thus forming a relatively sparse surface. As a result, in the subsequent etching step, ununiform etching is liable to occur, thus providing the gentle wavy surface as shown in FIG. 3B.

It is also possible to appropriate control a surface unevenness of the resultant zinc oxide layer surface by regulating the thickness of the above-mentioned upper layer in addition to the above surface shape-controlling methods.

If the above-described surface shape-controlling methods are appropriately used in combination, the resultant zinc oxide layer has a further optimized uneven surface (in a gentle wavy surface shape), thus improving light-confining and scattering effects of the photo-electricity generating device. As a result, the photo-electricity generating device thus prepared in further improved in photoelectric properties and qualities.

In the production process of the present invention, it is possible to suppress anomalous growth of the zinc oxide crystal by the addition of a carbohydrate in the aqueous solution for electrodeposition. If anomalous growth in a plate or sheet shape occurs in the resultant zinc oxide layer a semiconductor layer formed thereon is locally thin at the plate-shaped anomalous growth portion, where an excessive leakage current occurs. As a result, the photo-electricity generating device does not function as a practical photo-electricity generating device.

The carbohydrate may comprise a a monosaccharide, a disaccharide or polysaccharide and mixtures thereof. Examples of the monosaccharide may include gulcose (grape sugar) and fructose (fruit sugar). Examples of the disaccharose may include maltose (malt sugar) and saccharide (sucrose or cane sugar). Examples of the polysaccharide may include dextrin and starch.

The aqueous solution may preferably contain saccharide in a concentration of 1–300 g/l, or dextrin in a concentration of 0.001–10 g/l. Below the above preferred ranges the anomalous growth cannot readily be suppressed. Above the ranges, the resultant zinc oxide layer has an almost flat surface, thus decreasing pits necessary to form a desirable surface unevenness (gentle may shape).

A larger current density may be industrially advantageous to effective electrodeposition but, when the zinc oxide layer is formed at a current density above 5 $mA/cm^2$, anomalous growth portions in a standing plate shape having a (maximum) height of at least 10 $\mu$m become noticeable. By adding the above-mentioned carbohydrate in the electrolytic solution, it is possible to substantially suppress such anomalous growth portions, thus improving a production yield of the resultant photo-electricity generating device.

In the present invention, the zinc oxide layer (including two layer-structure, such as the upper and lower zinc oxide layers (103*a* and 104*a* in FIG. 1A) and the first and second zinc oxide layers (103*b* and 104*b* in FIG. 1B)) may preferably have a total (entire) thickness of 0.7–3 $\mu$m.

In the case of forming the upper layer to be etched on the lower layer (FIG. 1A), the upper layer may preferably have a thickness of at least 0.2 $\mu$m and the lower layer may preferably have a thickness of at least 0.5 $\mu$m while satisfying the total thickness of 0.7–3 $\mu$m.

If the zinc oxide layer has a total thickness below 0.7 $\mu$m, a density of generated pits per unit area necessary for the etching treatment providing a desirable surface unevenness is extremely decreased and the resultant surface shape contributes little to the light-confining and scattering effects at a wavelength of 600–1000 nm. If the zinc oxide layer has a total thickness above 3 $\mu$m, a density of generated anomalous growth portions in a standing plate shape becomes large. The formation of the thicker zinc oxide layer is disadvantageous industrially and is expensive.

Further, when the lower layer is formed in a thickness below 0.5 $\mu$m, a denseness of the resultant zinc oxide layer becomes insufficient, thus being liable to cause undesirable pits for the etching treatment. When the upper layer is formed in a thickness of below 0.2 $\mu$m, a density of generated pits necessary for the etching treatment becomes extremely small and a depth (height) of a surface unevenness after effecting the etching treatment becomes insufficient.

In the case where the zinc oxide layer is constituted by forming the second zinc oxide layer on the first zinc oxide layer to be etched (FIG. 1B), the first zinc oxide 3layer may preferably have a thickness of at least 0.5 $\mu$m and the second zinc oxide layer may preferably have a thickness of at least 0.05 $\mu$m while satisfying the total thickness of 0.7–3 $\mu$m. If the second zinc oxide layer is formed in a thickness of below 0.05 $\mu$m, it is difficult to completely fill deep pits generated at the first zinc oxide layer surface.

Hereinbelow, other structural members (elements) of the photo-electricity generating device produced through the process according to the present invention will be described.

<Electroconductive Substrate>

The electroconductive substrate used in the present invention may comprises a single plate or sheet of an electroconductive material or a support coated with one or two or more films. The support may be electrically insulating as long as one surface thereof is electroconductive.

Examples of the electroconductive material may Include: metals, such as Cu, Ni, Cr, Fe, Al, Mo, Nb, Ta, V and Rh; and alloys of these metals and alloys of the above metal(s) with other metals. These materials can be formed in a single plate or sheet. Among these materials, a material selected from the group consisting of stainless steel, steel, copper, brass and aluminum may preferably be used. Further, in view of a processability, strength, chemical stability and production costs, stainless steel and Fe may more preferably be used as the material for the elect roconductive substrate.

Example of an insulating material for the support at least one of which surface is coated with the electroconductive material (as described above) may include glass; ceramics; and synthetic resins, such as polyester, polyethylene, polycarbonate, cellulose acetate, polypropylene, polyvinyl chloride, polyvinylidene chloride, polystyrene, and polyamide.

The electroconductive substrate may preferably be used in a form of sheet (or plate) or a continuous (rolled or coiled) sheet wound about a cylindrical body (shaft).

In the case where the electroconductive substrate is formed by forming the metal layer on the (insulating) support, the metal layer may be formed by various processes including vacuum vapor deposition, sputtering, screen printing, dipping, plasma chemical vapor deposition (plasma CVD), electroplating and electroless plating.

The electroconductive substrate may be provided with a surface unevenness by etching the electroconductive substrate surface with an acid solution (etchant), such as $HNO_3$, HF, HCl, $H_2SO_4$ or by rubbing the substrate surface.

The surface of the electroconductive substrate may desirably be washed or cleaned with a surfactant or other organic substances in order to prevent peeling-off of its overlying layers (e.g., the backside reflection layer and zinc oxide layer).

<Backside Reflection Layer>

The backside reflection layer may be formed in a single layer or plural layers each comprising Au, Ag, Cu or Al.

The backside reflection layer may preferably be formed in a thickness (total thickness for the plural layer-type) of 0.05–0.5 μm. Below 0.05 μm, a resultant reflectance is undesirable decreased. Above 0.5 μm, the formation of such a layer becomes expensive.

The backside reflection layer may preferably be formed through a vacuum vapor deposition process, a sputtering process or an electroplating process (an electrochemical deposition process in an aqueous solution).

The backside reflection layer may have a flat (smooth) surface or an uneven surface. When the backside reflection layer is formed by sputtering at a substrate temperature of at least 150° C., the resultant backside reflection layer is provided with a surface unevenness, thus improving adhesive properties between the backside reflection layer and the electroconductive substrate.

<Intermediate Layer>

As the backside reflection layer for the photo-electricity generating device, an aluminum (Al) layer is a most promising layer since Al shows a high reflectance with respect to a light (wavelength=600–1000 nm) and does not cause electrochemical migration. As described hereinabove, however, it is difficult to directly deposit the zinc oxide layer on the Al layer by an electrochemical process (electroplating).

Accordingly, an intermediate layer may preferably be formed in a thickness of at least 0.01 μm on the backside reflection layer. Below 0.01 μm, the resultant intermediate layer is liable to be formed in an island or discrete shape.

The intermediate layer is required to be transparent to a light (wavelength=600–1000 nm) and have an appropriate eletroconductivity (preferably at least $10^{-8}$ ohm.cm).

Examples of a material for the intermediate layer may include tin oxide ($SnO_2$), indium oxide ($In_2O_3$), indium-tin oxide (ITO; $SnO_2$—$In_2O_3$), zinc oxide (ZnO), indium-zinc oxide and tin-zinc oxide.

These oxide layers (as the intermediate layer) may be formed by sputtering, CVD or vacuum vapor deposition.

On the intermediate layer or the backside reflection layer, the above-described zinc oxide layer is formed and etched to provide an optimum surface unevenness (in a gentle wavy shape), thus allowing sufficient light-confining and scattering actions even with respect to the light (wavelength= 600–1000 nm). The resultant photo-electricity generating device produced by the process of the present invention is excellent in qualities and is prepared at a low power consumption.

<Semiconductive Layer>

The semiconductor layer (e.g., 105 in FIGS. 1A and 1B) formed on the zinc oxide layer(s) may be of pn junction-type, pin junction-type, Shottky junction-type and heterojunction-type. Examples of a material for the semiconductor layer may include amorphous (a-)silicon hydride, amorphous silicon germanium hydride, amorphous silicon carbide hydride, microcrystalline (μc-)silicon and polycrystalline silicon.

Particularly, amorphous or microcrystalline Si, C, Ge or alloys thereof may suitable be used as the material for the semiconductor layer formed on the zinc oxide layer when the continuous support is used. These materials may also preferably contain hydrogen and/or halogen in an amount of 0.1–40 atomic %, and may further include oxygen atom and/or nitrogen atom at a concentration of at most $5\times10^{19}$ $cm^{-3}$.

Further, in order to provide a p-type semiconductor layer and an n-type semiconductor layer, Group III elements and Group V elements may be added in the semiconductor layers 704, respectively.

When the photo-electricity generating device has a stacked cell structure comprising plural semiconductor layers each including pin junction, an i-type constituting layer of the pin junction-type semiconductor layer closer to the side through which incident light passes may preferably have a broader band gap and a constituent layer may preferably have a narrower band gap with an increasing distance from the incident side of light. Further, within the respective i-type layer, a portion closer to the adjacent p-type layer may preferably have a minimum of the band gap compared with a central portion.

The doping layer on the incident side of light may preferably be made of a crystalline semiconductor showing less light absorption or a semiconductor having a broader band gap.

The semiconductor layer 105 may preferably be formed through microwave plasma chemical vapor deposition (MW plasma CVD) or radio frequency plasma chemical vapor deposition (RF plasma CVD).

<Transparent Electrode>

The transparent electrode (electroconductive layer) (e.g., 106 in FIGS. 1A and 1B) may be formed in an appropriate thickness, thus also functioning as a reflection-preventing layer.

The transparent electrode 105 may generally be formed by using a material, such as ITO (indium tin oxide), ZnO or $InO_3$, through vapor deposition, CVD, spray coating, spinner coating or dip coating.

The transparent electrode 106 may further contain a substance for changing (controlling) an eletroconductivity.

<Collector Electrode>

The collector (grid) electrode (e.g., 107 in FIGS. 1A and 1B) is formed for improving a charge (or current)-collection efficiency. The collector electrode may generally be formed by processes including one wherein a metal electrode pattern is formed by sputtering with a mask; a printing process with an electroconductive paste or solder paste; and one wherein a metal wire is fixed by using an electroconductive paste.

The photo-electricity generating device produced by the process according to the present invention may be covered with protective layers at both sides thereof. Iii this case, reinforcing members such as steel sheet or plate, may be used in combination with the protective layers.

Hereinbelow, the present invention will be described more specifically based on Examples.

EXAMPLE 1 AND COMPARATIVE EXAMPLES 1-A AND 1-B

(Example 1)

A 0.8 μm-thick Ag layer (backside reflection layer) was formed on a stainless steel substrate (SUS430; 100×100×0.2 mm) by sputtering.

On the Ag layer, a 1.6 μm-thick zinc oxide layer was formed under conditions shown in Table 1 (appearing hereinafter) and was then etched under conditions shown in Table 1.

Thereafter, on the zinc oxide layer, a semiconductor layer comprising three pin junctions was formed under conditions shown in Table 6.

On the semiconductor layer, a 0.08 μm-thick ITO (indium tin oxide) film (as an upper transparent electrode) was formed by sputtering and thereon, Ag-coated Cu wires (as a collector electrode) were bonded thereto with carbon paste under heating and pressure application, thus preparing a photo-electricity generating device.

Comparative Example 1-A

A photo-electricity generating device was prepared in the same manner as in Example 1 except that a 1.6 μm-thick zinc oxide layer was formed by a conventional sputtering process.

Comparative Example 1-B

A photo-electricity generating device was prepared in the same manner as in Example 1 except that the zinc oxide layer was not etched.

The thus prepared photo-electricity generating devices were subjected to measurement of a photoelectric conversion efficiency and a short circuit current at an initial stage by using a solar simulator (air mass (AM)=1.5; 100 mW/cm$^2$; at 25° C.) (weathering test).

Then, each photo-electricity generating device was evaluated in the similar manner as in the initial stage after a high-temperature and high-humidity test (HH test) as an accelerated test wherein the photo-electricity generating device was left standing for 150 hours in an environmental test box at a temperature of 86° C. and a humidity of 85%RH and was further left standing for 1 hour therein at 25° C. and 50%RH.

Further, each photo-electricity generating device was subjected to measurement of photoelectric conversion efficiency after exposing it to light for 800 hours by using the solar simulator (AM=1.5; 100 mW/cm$^2$; at 50° C.).

Evaluation of respective photoelectric properties was performed as a relative comparison wherein the photoelectric conversion efficiencies and short circuit currents of the photo-electricity generating device prepared in Example 1 were determined by taking those of the photo-electricity generating devices prepared in Comparative Examples 1-A and 1-B as "1", respectively.

As the initial evaluation result, the photo-electricity generating device of Example 1 was found to provide the initial photoelectric conversion efficiency being 1.14 times that of the photo-electricity generating device of Comparative Example 1-A and 1.07 times that of the photo-electricity generating device of Comparative Example 1-B.

Similarly, the photo-electricity generating device of Example 1 showed the initial short circuit current being 1.15 times that of the device of Comp. Ex. 1-A and 1.13 times that of the device of Comp. Ex. 1-B.

As the results of the HH test, the photo-electricity generating device of Example 1 were found to provide the photoelectric conversion efficiency and short circuit current where were 1.08 times and 1.12 times those of the device of Comp. Ex. 1-A, respectively, and which were 1.06 times and 1.10 times those of the device of Comp. Ex. 1-B, respectively.

Further, as the results of the weathering test, the photo-electricity generating device of Example 1 showed the photoelectric conversion efficiency being 1.04 times that of the device of Comp. Ex. 1-A and 1.03 times that of the device of Comp. Ex. 1-B.

Example 2

A photo-electricity generating device as shown in FIG. 1A was prepared and evaluated in the same manner as in Example 1 except that a zinc oxide layer consisting of an upper layer and a lower layer was formed under conditions shown in Table 2 and the etching conditions were changed to those shown in Table 2.

As a result, the photo-electricity generating device was found to show excellent photoelectric properties (photoelectric conversion efficiencies and short circuit currents) similar to those of the photo-electricity generating device of Example 1 (in comparison with Comparative Examples 1-A and 1-B).

Further, the photo-electricity generating device after effecting the HH and weathering tests was subjected to measurement of a leakage current in a dark place under application of a reverse bias voltage of 1.1 V.

As a result, the photo-electricity generating device provided the leakage current which was ca. 1/10 of that of the device of Comparative Example 1-A.

Example 3

A 0.05 μm-thick Al layer (backside reflection layer) and a 0.1 μm-thick zinc oxide layer (intermediate layer) were successively formed on a continuous stainless steel (SUS430BA) sheet (width=30 cm, length=800 m, thickness=0.15 mm) by sputtering according to a so-called Roll-to-Roll scheme.

Figure 4A:
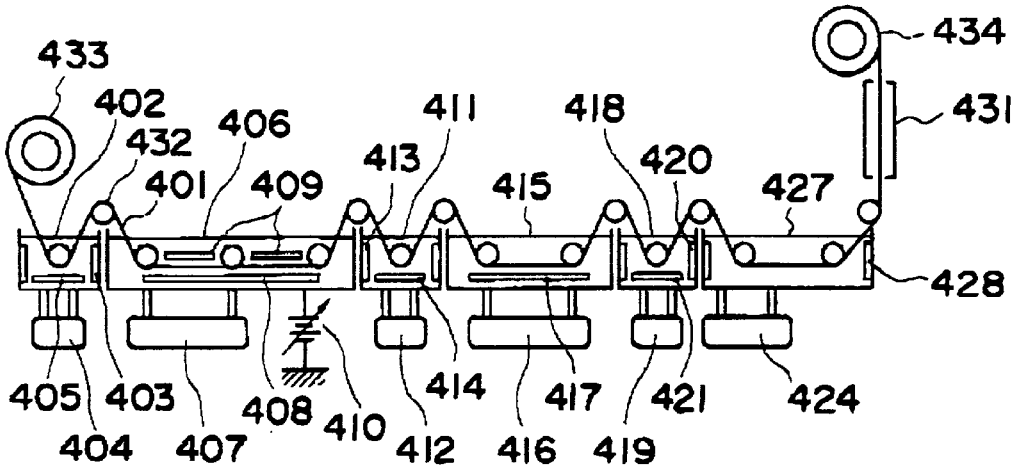
FIGS. 4A–4C are respectively a schematic sectional view showing an apparatus for forming and etching a zinc oxide layer with respect to a continuous electroconductive substrate (sheet) used in the present invention.

On the intermediate zinc oxide layer, a 1.75 μm-thick zinc oxide layer was formed under conditions shown in Table 3 by using a continuous film-forming and etching apparatus (Roll-to-Roll scheme) as shown in FIG. 4A.

Referring to FIG. 4A, in the apparatus, a flexible continuous sheet of stainless steel 401 to which backside an insulating tape (sheet) was supplied (not shown) was supplied from a lead-on (delivery) roller 433 about which the continuous stainless steel sheet was wound and was conveyed by conveyance rollers 432 via respective tanks to a wind-up (take-up) roller 434 to which the steel was wound up in a rolled (coiled) shape. The respective rollers had a diameter of at least 40 cm in view of plastic deformation.

The continuous sheet 401 was first supplied to a first washing tank 402 for effecting ultrasonic cleaning. The tank 402 included therein ultrasonic vibration plates 403 and a heater 405 and was connected to a circulating system 404 including a filter for removing suspended impurities and insoluble matters.

Then the sheet 401 was conveyed to an electrodeposition tank 406 connected to a circulating system 407 provided with a filter for removing suspended impurities and also connected to an external constant-current (power) supply 410. In the tank 406, a counter zinc electrode 408 and heaters 409 were oppositely disposed, and between which the sheet 401 was conveyed. The tank 406 contained a zinc nitrate aqueous solution to which a saccharose was added. The circulating system 407 monitored the concentration of the zinc nitrate aqueous solution and supplemented a fresh zinc nitrate aqueous solution when the zinc nitrate concentration was decreased. The electrodeposition of zinc oxide on the sheet 401 was performed under conditions shown in Table 3.

After the electrodeposition, the sheet 401 was washed by ultrasonic cleaning with pure water in a second washing tank 411 in which ultrasonic vibration plates 413 and a heater 414 were disposed. The tank 411 was connected with a circulating system 412 provided with a filter for removing suspended impurities.

After the ultrasonic washing, the surface of the zinc oxide layer of the sheet 401. was etched in an etching tank 415 connected with a circulating system 416 enclosing therein a filter for removal of suspended impurities. In the tank 415, a heater 417 was disposed and an acetic acid aqueous solution was filled. The circulating system 416 also functioned as a system for monitoring the acetic acid concentration and supplementing a fresh acetic acid when the acetic acid concentration was decreased. The etching conditions were shown in Table 3.

Then, the etched zinc oxide layer of the sheet 401 was washed in a third washing tank 418 similar to the first washing tank 411. The tank 418 included a heater 421 and ultrasonic vibrating plates 420 and was connected to a circulating system 419.

The sheet 401 was then conveyed in a fourth washing tank 427 connected with a circulating system 424 including a filter for removal of suspended impurities. In the tank 427, alcohol was filled and ultrasonic vibration plates 428 were disposed.

The thus washed sheet 401 was then dried by a drying means 431 for effecting warm air drying, followed by wind-up by the wind-up roller 434.

In the respective tanks, the peripheral devices or equipments (circulating systems, heaters, ultrasonic vibration plates) were actuated, respectively. The temperature of the water in the first washing tank 402 was set to be equal to that of the zinc nitrate aqueous solution in the electrodeposition tank 406. Similarly, the temperature of the water in the second washing tank 411 was set to be equal to that of the acetic acid aqueous solution in the etching tank 415. Further, the water temperature of the third washing tank 418 was set to be ca. 80° C. Temperature control of these waters was performed by the associated heaters, respectively.

The continuous formation of the zinc oxide layer was performed by setting the constant-current supply 410 so as to provide a prescribed current density. After the zinc oxide layer was formed on the entire sheet (800 m in length), etched and dried, the respective devices (constant-current supply, heaters, ultrasonic vibration plates, heaters, circulating systems conveyance rollers, etc.) were turned off or terminated to take the sheet 401 out from the continuous apparatus.

On the zinc oxide layer of the sheet 401, a semiconductor layer was formed by CVD, according to Roll-to-Roll scheme under conditions shown in Table 6 in the same manner as in Example 1, followed by formation of a 0.08 μm-thick ITO film by sputtering according to Roll-to-Roll scheme to prepare a rolled sheet.

The rolled sheet was cut into device units (30×30 cm) each of which was provided with a collector electrode in the same manner as in Example 1. Four device units were arranged in series connection via busbars and connected with bypass diodes in parallel connection form, thus preparing a solar cell (photo-electricity generating device).

Thereafter, an ethylene vinyl acetate (EVA) layer, a nylon resin layer, an EVA layer, a nonwoven fabric of glass, the series-connected solar cell, a nonwoven fabric of glass, an EVA layer, a nonwoven fabric of glass, an EVA layer, a nonwoven fabric of glass, and a fluorine-containing layer were formed in this order on a 0.3 mm-thick support (stainless steel sheet) by vacuum sealing (lamination) under heating, thus preparing a solar cell module (35×130 cm).

The thus prepared solar cell module was evaluated in the same manner as in Example 1, whereby the module was found to exhibit excellent photoelectric properties similarly as in the photo-electricity generating device prepared in Example 1.

The solar cell module was then subjected to a torsional test according to JIS C 8917 (for solar cells).

More specifically, the torsional test was performed by exerting torsion (displacement of 3 cm) 50 times on each corner of the module (total 200 times for four (entire) corners thereof).

When the solar cell module was subjected to measurement of photoconductive properties, a leakage current, an open circuit voltage at a low illuninance after the torsional test, the solar cell module was deteriorated little when compared with those before the torsional test.

Example 4

A photo-electricity generating device was prepared and evaluated in the same manner as in Example 1 except that a zinc oxide layer consisting of an upper layer and a lower layer was formed under conditions shown in Table 4 so that the current density and solute (zinc nitrate providing nitrate and zinc ions) concentration for the upper layer were set to be lower than those for the lower layer.

As a result of the evaluation, the resultant photo-electricity generating device was found to exhibit better performances similarly as in the device of Example 1.

Example 5

Figure 4B:
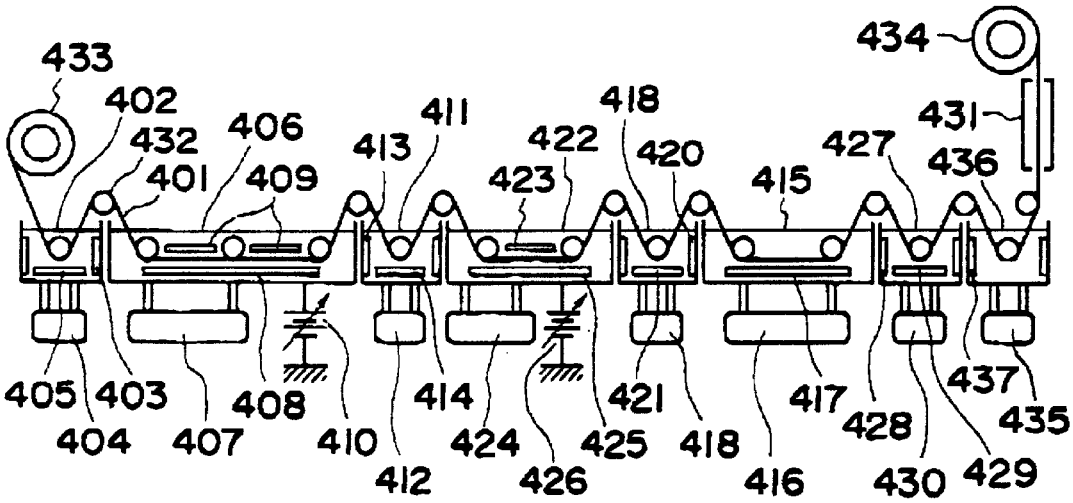

A solar cell module was prepared by using an apparatus shown in FIG. 4B and evaluated in the same manner as in Example 3 except that a zinc oxide layer consisting of an upper layer and a lower layer was formed in electrodeposition tanks 406 and 422, respectively, under conditions shown in Table 5.

Specifically, the current density and solute (zinc nitrate) concentration for the upper layer were set to be lower than those for the lower layer. Further, the apparatus shown in FIG. 4B was identical to the apparatus shown in FIG. 4 except for further including an additional electrodeposition tank 422 and an additional washing tank 418 disposed between the second washing tank 411 and the etching tank 415. The electrodeposition tank 422 included or was connected with respective means 423–426 corresponding to those (409, 407, 409 and 410) for the (first) electrodeposition tank 406, respectively. Further, the washing tank 418 was provided with respective means 419–421 corresponding to those (412–414) for the second washing tank 411, respectively.

As a result of the evaluation, the resultant solar cell module showed excellent properties similar to those attained by the module of Example 3.

Example 6

A photo-electricity generating device was prepared and evaluated in the same manner as in Example 1 except that the acetic acid aqueous solution (0.13 mol/l) for etching was changed to an acetic acid aqueous solution (0.0005 mol/l).

The resultant photo-electricity generating device was found to exhibit better performances similarly as in the device of Example 1.

Example 7

A photo-electricity generating device was prepared and evaluated in the same manner as in Example 1 except that the acetic acid aqueous solution (0.13 mol/l) for etching was changed to a hydrochloric acid aqueous solution (0.005 mol/l).

The resultant photo-electricity generating device was found to exhibit better performances similarly as in the device of Example 1.

Example 8

A photo-electricity generating device was prepared and evaluated in the same manner as in Example 1 except that the acetic acid aqueous solution (0.13 mol/l) for etching was changed to a sodium acetate aqueous solution (0.1 mol/l).

The resultant photo-electricity generating device was found to exhibit better performances similarly as in the device of Example 1.

Example 9

Photo-electricity generating devices were prepared in the same manner as in Example 2 except that the saccharide content (10 g/l) was changed from 0 g/l to 800 g/l.

Figure 5:
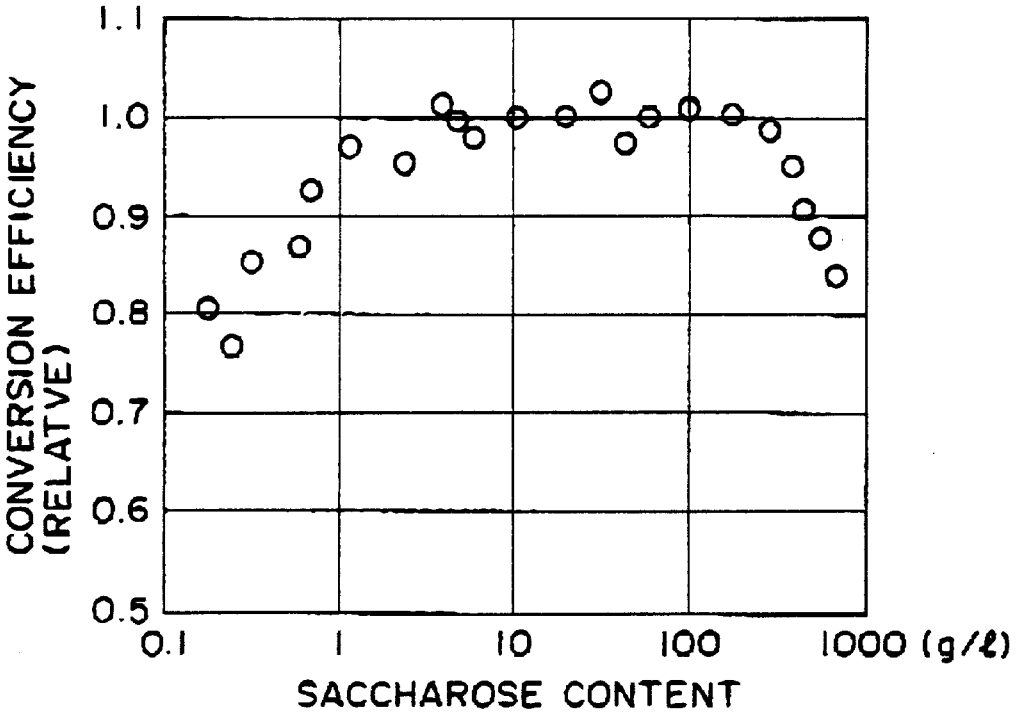
FIGS. 5–11 are respectively graphs showing a relationship between a photoelectric conversion efficiency and a variable factor; the variable factor is saccharide content for FIGS. 5 and 10; ZnO layer thickness for FIG. 6; lower ZnO layer thickness for FIG. 7; upper ZnO layer thickness for FIG. 8; and dextrin content for FIGS. 9 and 11) as a result of Examples 9–13, 23 and 27, respectively.

The thus prepared photo-electricity generating devices were subjected to an initial photoelectric conversion efficiency in the same manner as in Example 2, whereby the results shown in FIG. 5 were obtained.

As apparent from FIG. 5, a higher photoelectric conversion efficiency was retained in the saccharide content range of 1–300 g/l.

When a sectional shape of the zinc oxide layer for each photo-electricity generating device was observed through a scanning electron microscope (SEM) (magnification=1000), the zinc oxide layers formed at the saccharide content below 1 g/l were found to have many anomalous growth portions in a standing or erected plate shape, thus causing an increased leakage current leading to a lowering in photoelectric conversion efficiency.

On the other hand, the zinc oxide layers formed at the saccharide content above 300 g/l were found to have a substantially flat or smooth surface, thus failing to provide a sufficient light-confining and diffusing effects to lower the resultant photoelectric conversion efficiency.

Example 10

Photo-electricity generating devices were prepared in the same manner as in Example 1 except that the thickness of the zinc oxide layer was changed from 0.2 μm to 3.7 μm.

Figure 6:
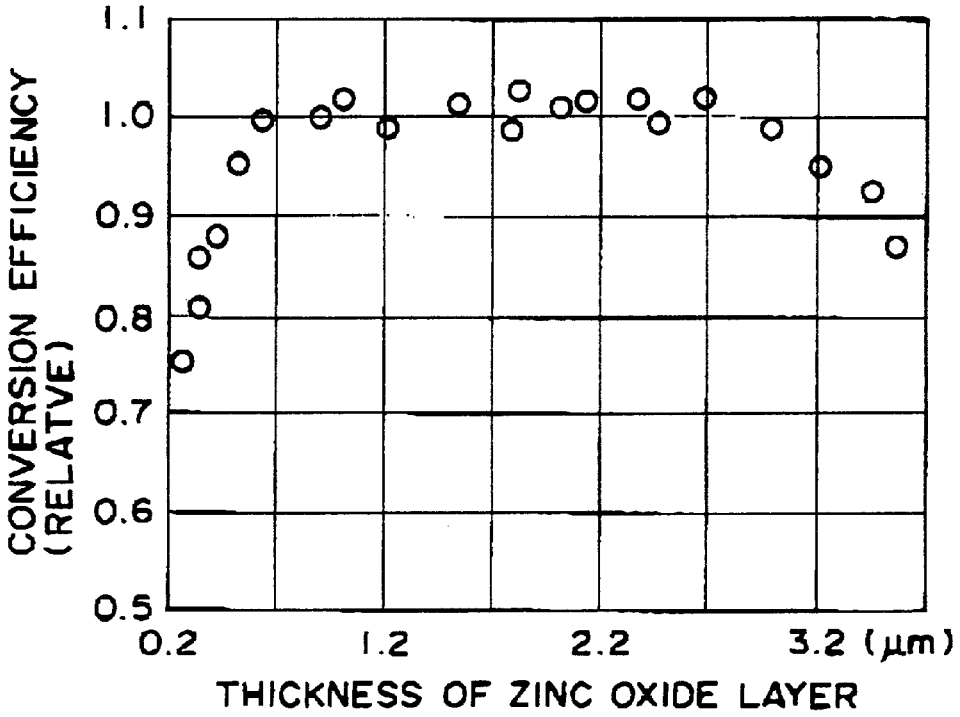

The thus prepared photo-electricity generating devices were subjected to an initial photoelectric conversion efficiency in the same manner as in Example 1, whereby the results shown in FIG. 6 were obtained.

As apparent from FIG. 6, a higher photoelectric conversion efficiency was retained in the zinc oxide layer thickness range of ca. 0.7–3 μm.

When a sectional shape of the zinc oxide layer for each photo-electricity generating device was observed through a SEM (magnification=1000), the zinc oxide layers having the thickness above 3 μm were found to have a larger density of anomalous growth portions in a standing or erected plate shape, thus causing an increased leakage current leading to a lowering in photoelectric conversion efficiency.

On the other hand, the zinc oxide layers formed the thickness below 0.7 μm showed decreased uneven surface portions presumably due to a considerable decrease in the number of deep pits suitable for etching, thus lowering a short circuit current of decrease the photoelectric conversion efficiency.

Example 11

Photo-electricity generating devices were prepared in the same manner as in Example 2 except that the lower layer thickness of the zinc oxide layer was changed from 0.2 μm to 1.2 μm.

Figure 7:
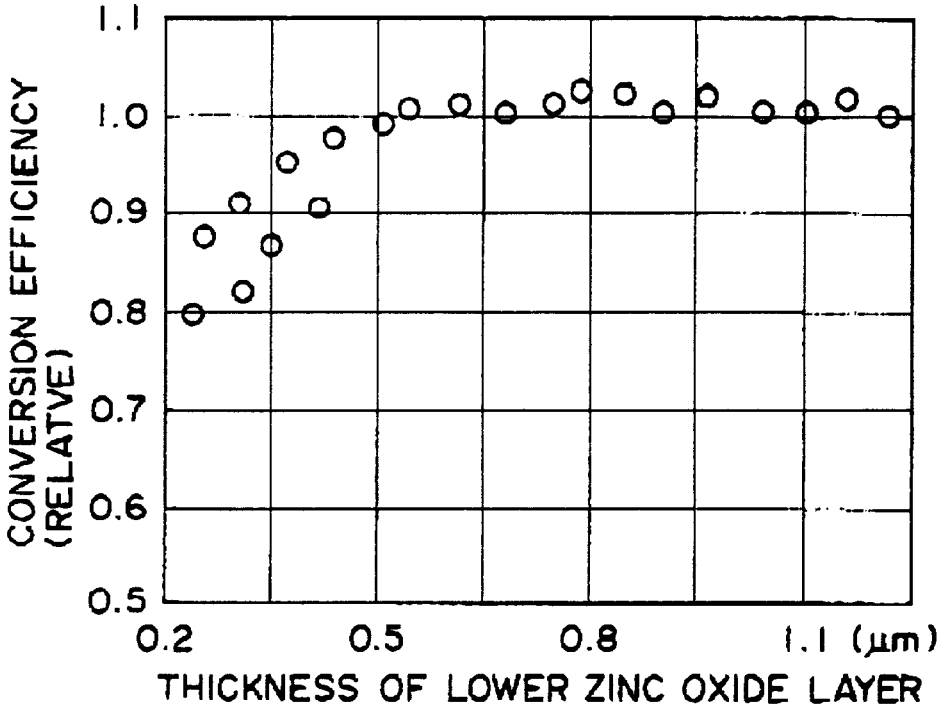

The thus prepared photo-electricity generating devices were subjected to an initial photoelectric conversion efficiency in the same manner as in Example 2, whereby the results shown in FIG. 7 were obtained.

As apparent from FIG. 7, a higher photoelectric conversion efficiency was attained in the lower layer thickness of at least 0.5 μm.

When a sectional shape of the zinc oxide layer for each photo-electricity generating device was observed through a SEM (magnification=1000), the zinc oxide layers having the lower layer thickness below 0.5 μm were found to have an insufficient denseness of zinc oxide particles, thus causing an increased leakage current presumably due to many deep pits unsuitable for etching, thus leading to a lowering in photoelectric conversion efficiency.

Example 12

Photo-electricity generating devices were prepared in the same manner as in Example 2 except that the upper layer thickness of the zinc oxide layer was changed from 0.05 μm to 0.75 μm.

Figure 8:
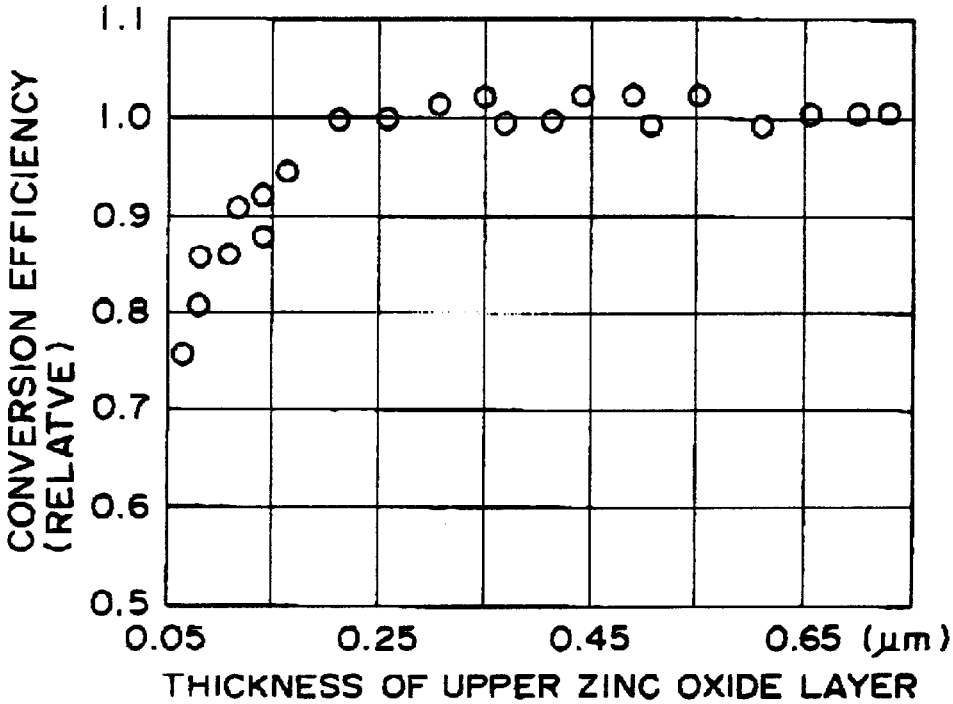

The thus prepared photo-electricity generating devices were subjected to an initial photoelectric conversion efficiency in the same manner as in Example 2, whereby the results shown in FIG. 8 were obtained.

As apparent from FIG. 8, a higher photoelectric conversion efficiency was attained in the upper layer thickness of at least 0.2 μm.

When a sectional shape of the zinc oxide layer for each photo-electricity generating device was observed through a SEM (magnification=1000), the zinc oxide layers having the upper layer thickness below 0.2 μm were found to have an insufficient surface unevenness in depth or height presumably due to a considerable decrease in density of deep pits suitable for etching, thus contributing little to confinement and scattering of light (wavelength=600–1000 nm). As a result, a short circuit current was decreased, thus resulting in a lowering in photoelectric conversion efficiency.

Example 13

Photo-electricity generating devices were prepared in the same manner as in Example 2 except that the saccharide for electrodeposition was changed to dextrin while changing its content from 0 g/l to 100 g/l.

Figure 9:
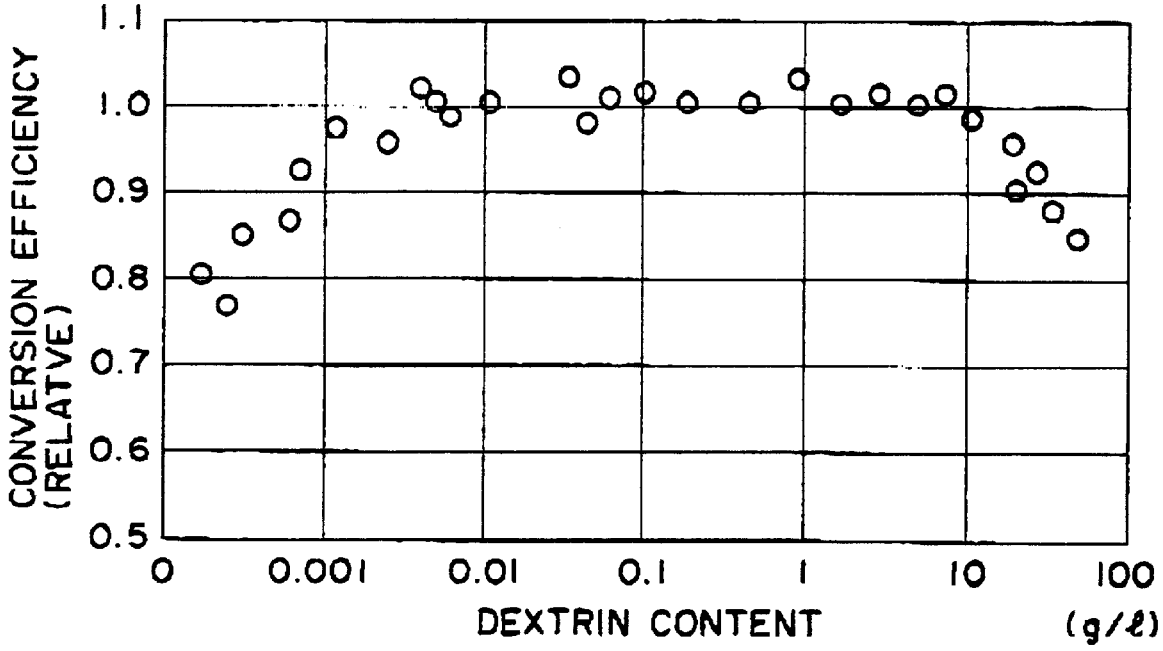

The thus prepared photo-electricity generating devices were subjected to an initial photoelectric conversion efficiency in the same manner as in Example 2, whereby the results shown in FIG. 9 were obtained.

As apparent from FIG. 9, a higher photoelectric conversion efficiency was retained in the dextrin content range of 0.001–10 g/l.

When a sectional shape of the zinc oxide layer for each photo-electricity generating device was observed through a SEM (magnification=1000), the zinc oxide layers formed at the saccharide content below 0.001 g/l were found to have many anomalous growth portions in a standing or erected plate shape, thus causing an increased leakage current leading to a lowering in photoelectric conversion efficiency.

On the other hand, the zinc oxide layers formed at the saccharide content above 10 g/l were found to have a substantially flat or smooth surface, thus failing to provide a sufficient light-confining and diffusing effects to lower the resultant photoelectric conversion efficiency.

Example 14

A photo-electricity generating device was prepared and evaluated in the same manner as in Example 3 except that the 0.1 μm-thick zinc oxide intermediate layer was changed to a 0.12 μm-thick tin oxide intermediate layer.

The resultant photo-electricity generating device was found to exhibit better performances similarly as in the device of Example 3.

Example 15

A photo-electricity generating device was prepared and evaluated in the same manner as in Example 2 except that the Ag backside reflection layer was changed to a Cu backside reflection layer.

The resultant photo-electricity generating device was found to exhibit better performances similarly as in the device of Example 2.

Example 16 and Comparative Example 2-A and 2-B

Example 16

A photo-electricity generating device as shown in FIG. 1B was prepared and evaluated in the same manner as in Example 1 except that a first zinc oxide layer was formed and etched and thereon a second zinc oxide layer was formed under conditions shown in Table 7 and that a semiconductor layer comprising three pin junctions was formed under conditions shown in Table 11.

Comparative Example 2-A

A photo-electricity generating device was prepared and evaluated in the same manner as in Example 16 except that the first and second zinc oxide layers were formed by a conventional sputtering process.

Comparative Example 2-B

A photo-electricity generating device was prepared and evaluated in the same manner as in Example 16 except that the first and second zinc oxide layers were not etched.

As a result of the evaluation, the photo-electricity generating device of Example 16 provided better performances shown below compared with those of the photo-electricity generating devices of Comparative Examples 2-A and 2-B, respectively.

| | Ex. 16 vs. Comp.Ex. 2-A | Ex. 16 vs. Comp.Ex. 2-B |
|---|---|---|
| Conversion efficiency (initial) | 1.15 | 1.08 |
| Short circuit current (initial) | 1.16 | 1.14 |
| Conversion efficiency (after HH test) | 1.07 | 1.05 |
| Short circuit current (after HH test) | 1.10 | 1.08 |
| Conversion Efficiency (after weathering test) | 1.02 | 1.03 |

Example 17

A photo-electricity generating device was prepared and evaluated in the same manner as in Example 16 except that a first zinc oxide layer consisting of a upper layer and a lower layer was formed and etched and thereon a second zinc oxide layer was formed under conditions shown in Table 8.

As a result, the photo-electricity generating device was found to show excellent photoelectric properties (photoelectric conversion efficiencies and short circuit currents) similar to those of the photo-electricity generating device of Example 16.

Further, the photo-electricity generating device after effecting the HH and weathering tests was subjected to measurement of a leakage current in a dark place under application of a reverse bias voltage of 1.1 V.

As a result, the photo-electricity generating device provided the leakage current which was ca. 1/10 of that of the device of Comparative Example 1-A.

Example 18

Figure 4C:
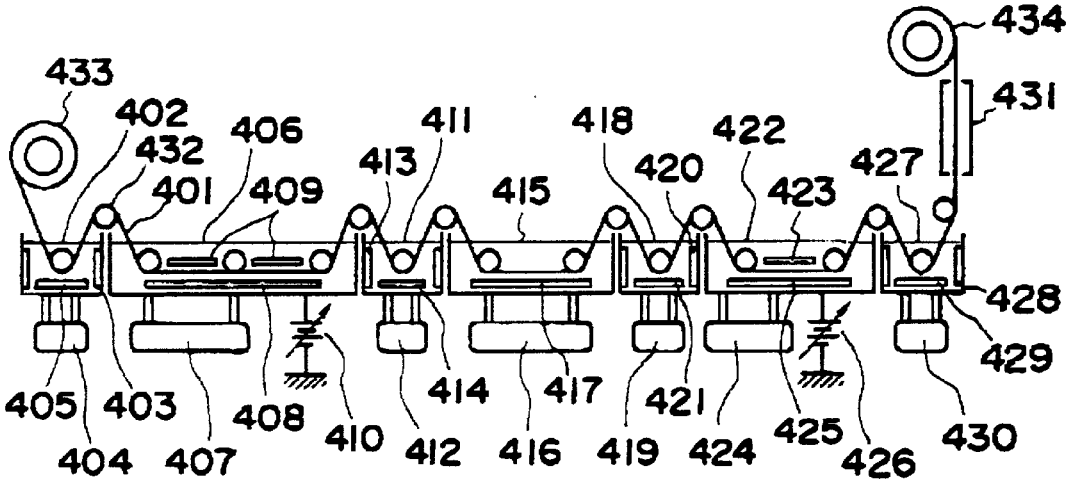

A solar cell module was prepared and evaluated in the same manner as in Example 3 except that the formation of a first zinc oxide layer, etching thereof and the formation of a second zinc oxide layer was performed by using an apparatus shown in FIG. 4C under conditions shown in Table 9 and that a semiconductor layer comprising three pin junctions was formed under conditions shown in Table 11. The apparatus of FIG. 4C was identical to that of FIG. 4A except for further including an electro-deposition tank 422 between the third and fourth washing tanks 418 and 427. The electrodeposition tank 422 was connected with a circulating system 424 and a constant-current supply 426 and included a counter electrode 425 and a heater 423.

As a result, the solar cell module showed excellent photoelectric properties (photoelectric conversion efficiencies and short circuit currents) at an initial stage, after the HH test and after the weathering test similar as in the module of Example 3.

Further, as a result of the torsional test, deteriorations in photoconductive properties, a leakage current and an open circuit voltage at a low illuminance were substantially not confirmed through the torsional test.

Example 19

A photo-electricity generating device was prepared in the same manner as in Example 16 except that a first zinc oxide layer consisting of an upper layer and a lower layer and a second zinc oxide layer were formed under conditions shown in Table 10 so that the current density and zinc nitrate concentration for the upper layer were set to be lower than those for the lower layer.

When the photo-electricity generating device was evaluated in the same manner as in Example 16, the photo-electricity generating device was found to exhibit better performances similarly as in the device of FIG. 16.

Example 20

A photo-electricity generating device was prepared and evaluated in the same manner as in Example 16 except that the acetic acid aqueous solution (0.01 mol/l) for etching was changed to an acetic acid aqueous solution (0.0005 mol/l).

The resultant photo-electricity generating device was found to exhibit better performances similarly as in the device of Example 16.

Example 21

A photo-electricity generating device was prepared and evaluated in the same manner as in Example 16 except that the acetic acid aqueous solution (0.01 mol/l) for etching was changed to a hydrochloric acid aqueous solution (0.005 mol/l).

The resultant photo-electricity generating device was found to exhibit better performances similarly as in the device of Example 16.

Example 22

A photo-electricity generating device was prepared and evaluated in the same manner as in Example 16 except that the acetic acid aqueous solution (0.01 mol/l) for etching was changed to a sodium acetate aqueous solution (0.1 mol/l).

The resultant photo-electricity generating device was found to exhibit better performances similarly as in the device of Example 16.

Example 23

Photo-electricity generating devices were prepared in the same manner as in Example 17 except that the saccharose content for forming the first zinc oxide layer was changed from 0 g/l to 800 g/l.

Figure 10:
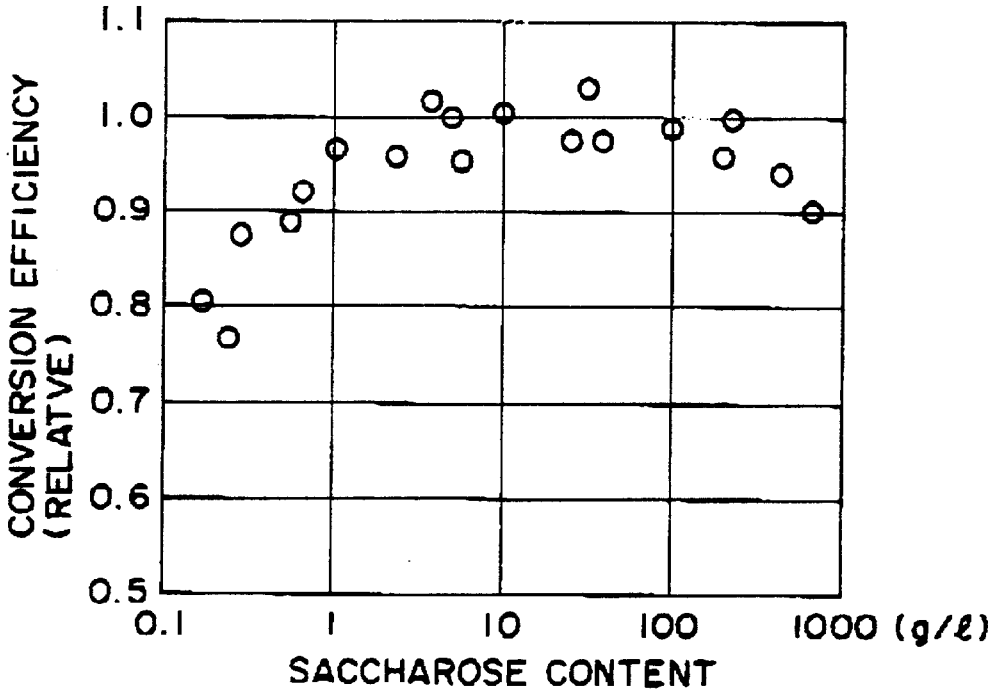

The thus prepared photo-electricity generating devices were subjected to an initial photoelectric conversion efficiency in the same manner as in Example 1, whereby the results shown in FIG. 10 were obtained.

As apparent from FIG. 10, a higher photoelectric conversion efficiency was retained in the dextrin content range of 1–300 g/l.

When a sectional shape of the zinc oxide layer for each photo-electricity generating device was observed through a SEM (magnification=1000), the zinc oxide layers formed at the saccharide content (for forming the first zinc oxide layer) below 1 g/l were found to have many anomalous growth portions in a standing or erected plate shape, thus causing an increased leakage current leading to a lowering in photoelectric conversion efficiency.

On the other hand, the zinc oxide layers is formed at the saccharose content above 300 g/l were found to have a substantially flat or smooth surface, thus failing to provide a sufficient light-confining and diffusing effects to lower the resultant photoelectric conversion efficiency.

With respect to the saccharose content for forming the second zinc oxide layer, similar results were obtained.

Example 24

A photo-electricity generating device was prepared and evaluated in the same manner as in Example 18 except that the 0.1 μm-thick zinc oxide intermediate layer was changed to a 0.12 μm-thick tin oxide intermediate layer.

The resultant photo-electricity generating device was found to exhibit better performances similarly as in the device of Example 18.

Example 25

A pholo-electricity generating device was prepared and evaluated in the same manner as in Example 17 except that the Ag backside reflection layer was changed to a Cu backside reflection layer.

The resultant photo-electricity generating device was found to exhibit better performances similarly as in the device of Example 17.

Example 26

A photo-electricity generating device was prepared and evaluated in the same manner as in Example 16 except that the saccharose (10 g/l) for the first and second zinc oxide layers were changed to dextrin (0.1 g/l), respectively.

The resultant photo-electricity generating device was found to exhibit better performances similarly as in the device of Example 16.

Example 27

A photo-electricity generating device was prepared and evaluated in the same manner as in Example 26 except that the dextrin content (0.1 g/l) for forming the first zinc oxide layer was changed from 0 g/l to 100 g/l.

Figure 11:
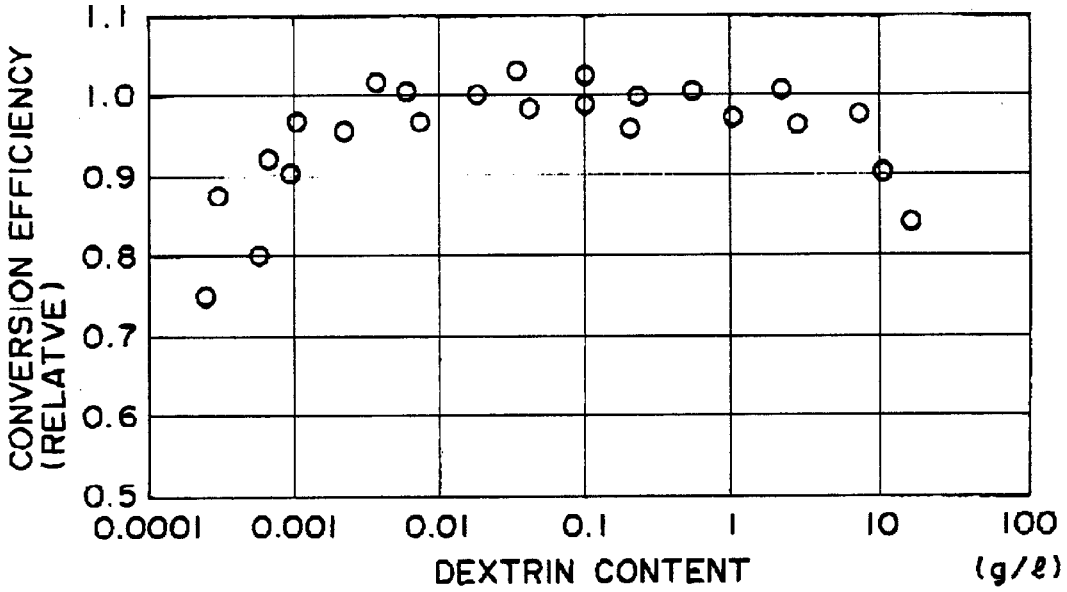

The resultant photo-electricity generating device was found to provide a higher photoelectric conversion efficiency in the dextrin content range of 0.001–10 g/l as shown in FIG. 11.

Similar results were obtained with respect to that for the second zinc oxide layer.

As described hereinabove, according to the process for producing a photo-electricity generating device of the present invention, it is possible to form a zinc oxide layer having an appropriate surface unevenness (in a gentle wavy shape) excellent in a light-confining effect, thus improving photoelectric (or photoconductive) properties, such as a photoelectric conversion efficiency, a short circuit current and a leakage current.

Further, the resultant photo-electricity generating device is improved in durability in terms of an outdoor weathering test, mechanical strength, HH test and weathering test and also can reduce production costs thereof.

In the following Tables 1–5 and 7–10, the thicknesses of the ZnO layers were those measured before the etching treatment. Further, the thicknesses (minus values) for the etching treatment means those of the ZnO layers removed by the etching treatment and determined based on interference waveforms obtained from reflection spectrum.

TABLE 1

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| ZnO layer formation | Zinc nitrate | 0.025 | 80 | 0.8 | 9 | 1.6 |
| Etching | Acetic acid | 0.13 | 25 | — | — | −0.35 |

TABLE 2

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| ZnO layer formation | | | | | | |
| lower | Zinc nitrate | 0.027 | 62 | 0.7 | 10 | 0.9 |

TABLE 2-continued

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| upper | Zinc nitrate | 0.027 | 85 | 0.7 | 10 | 0.5 |
| Etching | Acetic acid | 0.005 | 25 | — | — | −0.3 |

TABLE 3

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| ZnO layer formation | Zinc nitrate | 0.025 | 83 | 1.2 | 13 | 1.75 |
| Etching | Acetic acid | 0.1 | 35 | — | — | −0.32 |

TABLE 4

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| ZnO layer | | | | | | |
| lower | Zinc nitrate | 0.1 | 85 | 8.5 | 11 | 1.3 |
| upper | Zinc nitrate | 0.05 | 85 | 0.65 | 11 | 0.5 |
| Etching | Acetic acid | 0.1 | 25 | — | — | −0.3 |

TABLE 5

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| ZnO layer formation | | | | | | |
| lower | Zinc nitrate | 0.12 | 70 | 8 | 15 | 1.4 |
| upper | Zinc nitrate | 0.04 | 85 | 0.7 | 10 | 0.6 |
| Etching | Acetic acid | 0.12 | 30 | — | — | −0.4 |

TABLE 6

| Semiconductor layer | Material | Process | Temp. (° C.) | Thickness (μm) |
|---|---|---|---|---|
| 1st dope layer | n-type a-Si:H:P | RFCVD | 300 | 0.02 |
| 1st i-layer | i-type a-SiGe:H | MWCVD | 270 | 0.1 |

TABLE 6-continued

| Semiconductor layer | Material | Process | Temp. (° C.) | Thickness (μm) |
|---|---|---|---|---|
| 2nd dope layer | p-type μc-Si:H:B | RFCVD | 250 | 0.01 |
| 3rd dope layer | n-type a-Si:H:P | RFCVD | 250 | 0.01 |
| 2nd i-layer | i-type a-SiGe:H | MWCVD | 270 | 0.07 |
| 4th dope layer | p-type μc-Si:H:B | RFCVD | 250 | 0.01 |
| 5th dope layer | n-type a-Si:H:P | RFCVD | 230 | 0.01 |
| 3rd i-layer | i-type a-Si:H | RFCVD | 200 | 0.1 |
| 6th dope layer | p-type μc-Si:H:B | RFCVD | 165 | 0.01 |

TABLE 7

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| 1st layer formation | Zinc nitrate | 0.035 | 80 | 1.2 | 10 | 1.2 |
| Etching | Acetic acid | 0.01 | 25 | — | — | −0.2 |
| 2nd ZnO layer formation | Zinc | 0.2 | 85 | 7.8 | 10 | 0.1 |

TABLE 8

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| 1st ZnO layer formation | | | | | | |
| lower | Zinc nitrate | 0.025 | 60 | 0.7 | 10 | 0.8 |
| upper | Zinc nitrate | 0.025 | 85 | 0.7 | 10 | 0.5 |
| Etching | Acetic acid | 0.0005 | 25 | — | — | −0.2 |
| 2nd ZnO layer formation | Zinc nitrate | 0.2 | 85 | 7.8 | 10 | 0.1 |

TABLE 9

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| 1st layer | Zinc nitrate | 0.025 | 80 | 2.0 | 10 | 1.3 |

TABLE 9-continued

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| formation | | | | | | |
| Etching | Acetic acid | 0.005 | 25 | — | — | −0.2 |
| 2nd ZnO layer formation | Zinc nitrate | 0.2 | 85 | 7.8 | 10 | 0.1 |

TABLE 10

| Step | Aqueous solution | Solute concentration (mol/l) | Solution temp. (° C.) | Current density (mA/cm$^2$) | Saccharose content (g/l) | Thickness (μm) |
|---|---|---|---|---|---|---|
| 1st ZnO layer formation | | | | | | |
| lower | Zinc nitrate | 0.1 | 85 | 8.0 | 10 | 1.1 |
| upper | Zinc nitrate | 0.05 | 85 | 0.7 | 10 | 0.3 |
| Etching | Acetic acid | 0.005 | 25 | — | — | −0.2 |
| 2nd ZnO layer formation | Zinc nitrate | 0.1 | 85 | 8.0 | 10 | 0.07 |

TABLE 11

| Semiconductor layer | Material | Process | Temp. (° C.) | Thickness (μm) |
|---|---|---|---|---|
| 1st dope layer | n-type a-Si:H:P | RF plasma CVD | 300 | 0.02 |
| 1st i-layer | i-type a-SiGe:H | MW plasma CVD | 380 | 0.10 |
| 2nd dope layer | p-type μc-Si:H | RF plasma CVD | 200 | 0.005 |
| 3rd dope layer | n-type a-Si:H:P | RF plasma CVD | 220 | 0.01 |
| 2nd i-layer | i-type a-SiGe:H | MW plasma CVD | 380 | 0.09 |
| 4th dope layer | p-type μc-Si:H | RF plasma CVD | 200 | 0.005 |
| 5th dope layer | n-type a-Si:H:P | RF plasma CVD | 220 | 0.01 |
| 3rd i-layer | i-type a-Si:H | RF plasma CVD | 250 | 0.09 |
| 6th dope layer | p-type μc-Si:H | RF plasma CVD | 160 | 0.005 |

What is claimed is:

1. A process for producing a photo-electricity generating device, comprising the steps of:

immersing an electrode and an electroconductive substrate in an aqueous solution comprising at least nitrate ions and zinc ions, supplying a current passing through a gap between the electrode and the electroconductive substrate to form a first zinc oxide layer on the electroconductive substrate, wherein the first zinc oxide layer has pits at its surface, the pits having an average diameter of 0.05–0.3 μm, etching the first zinc oxide layer, and forming a semiconductor layer on the first zinc oxide layer.

2. A process according to claim 1, further comprising, between the etching step and the semiconductor layer-forming step, the steps of:

immersing the electrode and the electroconductive substrate having thereon the first zinc oxide layer in a second aqueous solution comprising nitrate ions and zinc ions, and supplying a current passing through a gap between the electrode and the electroconductive substrate to form a second zinc oxide layer on the first zinc oxide layer.

3. A process according to claim 1, wherein the first aqueous solution comprises a carbohydrate.

4. A process according to claim 3, wherein the carbohydrate comprises a monosaccharide, a disaccharide or a polysaccharide.

5. A process according to claim 1, wherein the first aqueous solution comprises a saccharide in an amount of 1–300 g/l.

6. A process according to claim 1, wherein the first aqueous solution comprises a dextrin in an amount of 0.001–10 g/l.

7. A process according to claim 1, wherein the first zinc oxide layer comprises an upper layer and a lower layer.

8. A process according to claim 7, wherein the upper layer is formed at a temperature higher than that for the lower layer.

9. A process according to claim 8, wherein the upper layer is formed at at least 80° C.

10. A process according to claim 7, wherein the upper layer is formed at a current density smaller than that for the lower layer.

11. A process according to claim 7, wherein the upper layer is formed at prescribed concentrations of nitrate ions and zinc ions, the prescribed concentrations being lower than those for the lower layer, respectively.

12. A process according to claim 1, wherein the etching step is performed by using an etchant comprising acetic acid or an acetic acid aqueous solution.

13. A process according to claim 1, further comprising a washing step before the first zinc oxide layer-forming step, or between the first zinc oxide layer-forming step and the etching step, or after the etching step.

14. A process according to claim 1, wherein the first zinc oxide layer has pits at its surface after effecting the etching step, the pits having an average diameter of 0.3–1.0 μm.

15. A process according to claim 1, wherein the first zinc oxide layer has pits at its surface before effecting the etching step, the pits having a density of 100–1000 pits/100 μm$^2$.

16. A process according to claim 1, further comprising the step of forming a second zinc oxide layer on the first zinc oxide layer by sputtering.

17. A process according to claim 1, wherein the electroconductive substrate comprising a sheet of a material selected from the group consisting of stainless steel, steel, copper, brass and aluminum.

18. A process according to claim 1, wherein the electroconductive substrate is coated with a metal layer.

19. A process according to claim 1, wherein the electroconductive substrate comprises a support of a material selected from the group consisting of glass, ceramic and resin, and a metal layer formed on at least one surface of the support.

20. A process according to claim 18 or 19, wherein the metal layer comprises a material selected from the group consisting of Au, Ag, Cu, Cu—Mg alloy and Al.

21. A process according to claim 18 or 19, wherein the metal layer comprises Al and is coated with an intermediate layer before the first zinc oxide layer-forming step.

22. A process according to claim 21, wherein the intermediate layer comprises a material selected from the group consisting of zinc oxide, tin oxide, indium oxide and indium tin oxide.

23. A process according to claim 1, wherein the first zinc oxide layer has a thickness of 0.7–3 μm.

24. A process according to claim 7, wherein the lower layer of the first zinc oxide layer has a thickness of at least 0.5 μm.

25. A process according to claim 7, wherein the upper layer of the first zinc oxide layer has a thickness of at least 0.2 μm.

26. A process according to claim 2, wherein the first zinc oxide layer has a thickness of at least 0.5 μm and the second zinc oxide layer has a thickness of at least 0.05 μm, the thickness in total being in a range of 0.7–3 μm.

27. A process according to claim 2, wherein the first aqueous solution or the second aqueous solution comprises a carbohydrate.

28. A process according to claim 27, wherein the carbohydrate comprises a monosaccharide, a disaccharide or a polysaccharide.

29. A process according to claim 2, wherein the first aqueous solution or the second aqueous solution comprises a saccharide in an amount of 1–300 g/l.

30. A process according to claim 2, wherein the first aqueous solution or the second aqueous solution comprises a dextrin in an amount of 0.001–10 g/l.

31. A process according to claim 2, wherein the first zinc oxide layer comprises an upper layer and a lower layer.

32. A process according to claim 31, wherein the upper layer is formed at a temperature higher than that for the lower layer.

33. A process according to claim 32, wherein the upper layer is formed at at least 80° C.

34. A process according to claim 31, wherein the upper layer is formed at a current density smaller than that for the lower layer.

35. A process according to claim 31, wherein the upper layer is formed at prescribed concentrations of nitrate ions and zinc ions, the prescribed concentrations being lower than those for the lower layer, respectively.

36. A process according to claim 2, wherein the etching step is performed by using an etchant comprising acetic acid or an acetic acid aqueous solution.

37. A process according to claim 2, further comprising a washing step before etching step, or between the etching step and the second zinc oxide layer-forming step, or between the second zinc oxide-forming step and the semiconductor layer-forming step.

38. A process according to claim 1, wherein the second zinc oxide layer has pits at its surface before effecting the etching step, the pits having an average diameter of 0.05–0.3 μm.

39. A process according to claim 2, wherein the second zinc oxide layer has pits at its surface after effecting the etching step, the pits having an average diameter of 0.3–1.0 μm.

40. A process according to claim 2, wherein the second zinc oxide layer has pits at its surface before effecting the etching step, the pits having a density of 100–1000 pits/100 $\mu m^2$.

41. A process according to claim 2, wherein the electroconductive substrate comprising a sheet of a material selected from the group consisting of stainless steel, steel, copper, brass and aluminum.

42. A process according to claim 2, wherein the electroconductive substrate is coated with a metal layer.

43. A process according to claim 2, wherein the electroconductive substrate comprises a support of a material selected from the group consisting of glass, ceramic and resin, and a metal layer formed on at least one surface of the support.

44. A process according to claim 42 or 43, wherein the metal layer comprises a material selected from the group consisting of Au, Ag, Cu, Cu—Mg alloy and Al.

45. A process according to claim 42 or 43, wherein the metal layer comprises Al and is coated with an intermediate layer before the first zinc oxide layer-forming step.

46. A process according to claim 45, wherein the intermediate layer comprises a material selected from the group consisting of zinc oxide, tin oxide, indium oxide and indium tin oxide.

47. A process according to claim 31, wherein the first zinc oxide layer and the second zinc oxide layer provide a total thickness of 0.7–3 μm.

48. A process according to claim 31, wherein the lower layer of the first zinc oxide layer has a thickness of at least 0.5 μm.

49. A process according to claim 31, wherein the upper layer of the first zinc oxide layer has a thickness of at least 0.2 μm.

* * * * *

UNITED STATES PATENT AND TRADEMARK OFFICE

CERTIFICATE OF CORRECTION

PATENT NO. : 6,123,824

DATED : September 26, 2000

INVENTOR(S) : MASAFUMI SANO ET AL.

It is certified that error appears in the above-identified patent and that said Letters Patent is hereby corrected as shown below:

ON THE TITLE PAGE [57] Abstract:

"electrudeposition" should read --electrodeposition--.

COLUMN 4

Line 55, "changed" should read --change--.

COLUMN 5

Line 3, "2E," should read --2B,--.

COLUMN 7

Line 1, "ununitorm" should read --ununiform--;
Line 16, "appropriate" should read --appropriately--;
Line 38, "a" (second occurrence) should be deleted; and
Line 40, "gulcose" should read --glucose--.

COLUMN 8

Line 24, "3layer" should read --layer--; and
Line 40, "Include:" should read --include:--.

UNITED STATES PATENT AND TRADEMARK OFFICE

CERTIFICATE OF CORRECTION

PATENT NO. : 6,123,824

DATED : September 26, 2000

INVENTOR(S) : .MASAFUMI SANO ET AL.

It is certified that error appears in the above-identified patent and that said Letters Patent is hereby corrected as shown below:

COLUMN 9

Line 13, "undesirable" should read --undesirably--; and
Line 67, "suitable" should read --suitably--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*